United States Patent [19]

Rensland et al.

[11] 4,005,841

[45] Feb. 1, 1977

[54] CHAIR BASE ARM END CAP

[75] Inventors: Thomas E. Rensland; Robert C. Clawson; Alexander A. Karrip, all of Grand Rapids, Mich.

[73] Assignee: Steelcase, Inc., Grand Rapids, Mich.

[22] Filed: Dec. 31, 1975

[21] Appl. No.: 645,517

[52] U.S. Cl. ..... 248/188.7; 108/150; 248/188.9; 297/440

[51] Int. Cl.[2] ..... F16M 11/20

[58] Field of Search ..... 248/188.7, 188.8, 188.9, 248/188.91; 138/89; 297/440; 108/150

[56] References Cited

UNITED STATES PATENTS

| | | | |
|---|---|---|---|
| 710,073 | 9/1902 | Pratt et al. | 248/188.9 X |
| 1,603,876 | 10/1926 | Shapard | 248/188.9 X |
| 3,206,150 | 9/1965 | Lang et al. | 248/188.8 X |
| 3,617,023 | 11/1971 | Schneiderman | 248/188.7 |

FOREIGN PATENTS OR APPLICATIONS

| | | | |
|---|---|---|---|
| 795,603 | 10/1968 | Canada | 248/188.7 |
| 630,092 | 12/1961 | Italy | 248/188.9 |
| 799,978 | 8/1958 | United Kingdom | 248/188.8 |

*Primary Examiner*—J. Franklin Foss
*Attorney, Agent, or Firm*—Price, Heneveld, Huizenga & Cooper

[57] ABSTRACT

The specification discloses an article of furniture, specifically a chair base, in which the open sockets at the ends of the base arms are capped by a cap including a cover portion and a plug portion extending into the arm socket, the plug extending over and beyond the top of the pintle socket which is inside the leg and including a barb extending downwardly behind a portion of the pintle socket, the barb being sufficiently flexible as to allow it to slide over the pintle socket and slip down behind at least a portion of it whereby insertion of the cap is facilitated but removal is not. The plug also includes inclined locking ridges which engage the interior surface of the socket to further secure the cap in place.

15 Claims, 6 Drawing Figures

CHAIR BASE ARM END CAP

BACKGROUND OF THE INVENTION

The present invention relates to furniture, particularly to items such as pedestal bases for chairs. Such pedestal bases include a central hub and radiating arms or legs. These arms are typically formed of tubular steel stock and the openings at the end of the arms must somehow be covered.

One typical way of covering these openings is to weld an end cap onto the arms. The weld surface is sanded and the entire base arm is then chrome plated. Such a procedure is, of course, fairly expensive.

To obviate this expense, some manufacturers have made molded plastic plugs. These molded plastic members are simply inserted into the ends of the base arms. While such an approach is inexpensive, the plugs have a tendency to fall out with continued use of the product and accordingly, this approach is not considered desirable by quality manufacturers.

One plastic plug which does not readily fall out is one that is not only a plug member, but also includes an integrally molded pintle receiving socket. Normally, the base arm of the pedestal base includes a steel tubular member welded to the end of the arm and extending generally laterally therefrom. The short tubular member is a pintle receiving socket which receives the pintle of a castor. When the castor pintle is integrally molded into the plastic end cap or plug, the need for a welded on pintle socket is eliminated. One simply provides a hole in the bottom surface of the base arm and after the plastic end cap is in place, the pintle is inserted through the hole and into the molded in pintle socket.

One problem with this approach is that the plastic pintle socket tends to wear with continued use and there is a tendency for the castors to fall out after some time. Also, assembly is somewhat complicated in that one has to be sure that the pintle socket in the end cap and the hole through which the castor pintle must extend are properly aligned when one inserts the castor pintle.

SUMMARY OF THE INVENTION

The present invention comprises an article of furniture, such as a chair base, in which a socket with an opening to be covered includes a detent member therein projecting from an interior surface of the socket. A cap for the socket includes a cover portion and a plug portion, the plug extending from the cover portion into the socket over and beyond the detent member and including a barb extending downwardly therefrom behind and adjacent the detent member. The barb is sufficiently flexible relative to the plug to allow it to slide over the detent member and slip down behind the detent member during insertion of the plug into the socket. Preferably, in the case of a chair base, the detent member comprises the pintle socket itself, since the pintle socket has to be present within the base arm anyway.

In another aspect of the invention, the plug portion of the end cap also includes annular ridges having sloped leading edges, the ridges having dimensions just slightly greater than the interior dimensions of the socket such that the insertion of the plug portion into the socket is facilitated as a result of the sloped leading edges of the ridges, but removal of the end cap member is eliminated by the tight fit.

These and other objects, advantages and features of the present invention will be more fully understood and appreciated by reference to the written specification and appended drawings.

DESCRIPTION OF THE PREFERRED EMBODIMENT

Figure 1:
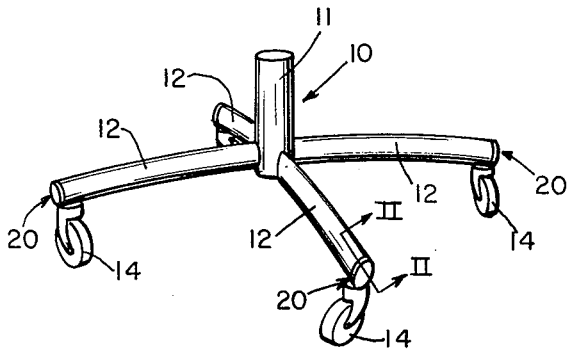
FIG. 1 is a perspective view of a chair base.
Figure 4:
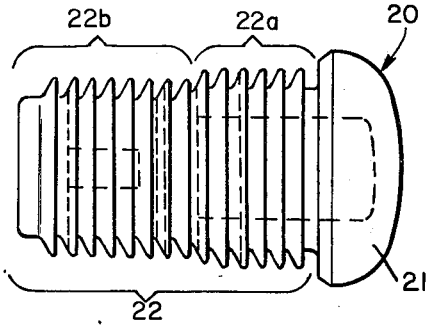
FIG. 4 is a top plan view of the end cap.
Figure 2:
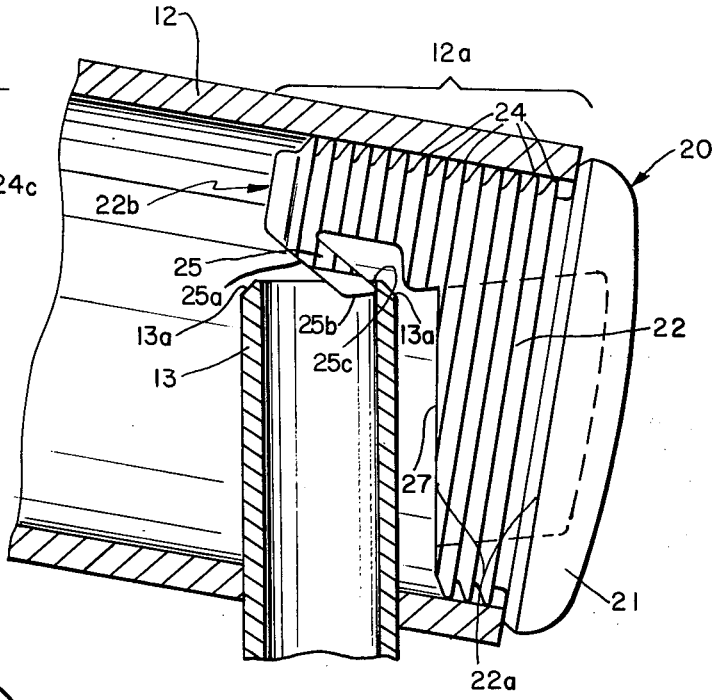
FIG. 2 is a cross-sectional view taken generally along plane II—II of FIG. 1, without showing the castor of the chair base itself.

Referring to FIG. 1, the end cap 20 of the present invention is shown in use in a chair base 10 having a central hub 11 and outwardly radiating arms 12. The end portion of each arm 12 defines in essence a socket 12*a* (FIG. 2). A short tubular steel member 13 extends through a hole in the bottom of arm 12 and into the interior of arm socket 12*a*. Member 13 defines a pintle socket for receiving the pintle of a castor such as castor 14 shown in FIG. 1.

End cap 20 is molded of a plastic material, preferably relatively hard so as to resist scuffing and abrasion. A polypropylene copolymer is one example of a plastic molding material which could be used.

End cap 20 includes a cover portion 21 which is slightly larger in perimeter dimensions than the opening of arm socket portion 12*a*. Cover 21 is shaped to a desired design configuration and is given a desired ornamental texture since it is the visible portion of end cap 20 when end cap 20 is in place. Its enlarged dimensions prevent it from slipping into the interior of arm socket 12*a*.

Extending from cover 21 is the plug portion 22 of end cap 20. Plug portion 22 is divided into a main body 22*a* and a plug extension 22*b*. Main body 22*a* has a peripheral configuration corresponding generally to the configuration of the interior of arm socket 12*a*. Main body 22*a* is cut off on a slanted terminal surface 27 so that main body 22*a* does not interfere with pintle socket 13. Thus, the slope of surface 27 is generally parallel to the pintle socket 13.

Figure 3:
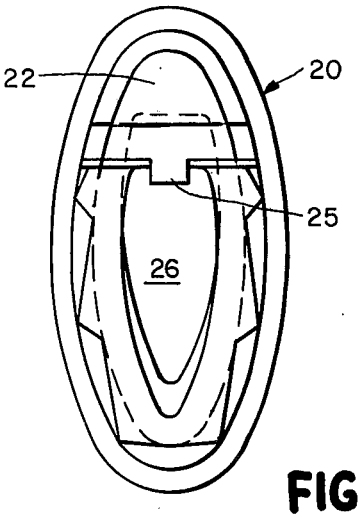
FIG. 3 is an end elevational view showing the end of the plug portion of the end cap.
Figure 5:
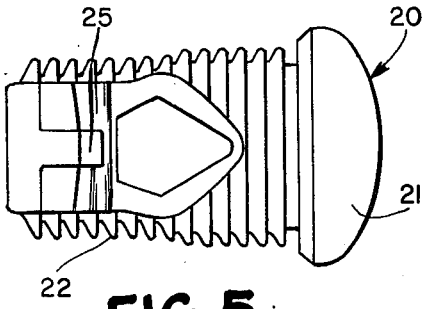
FIG. 5 is a bottom plan view of the end cap.

Plug extension 22*b* extends out over the top of castor pintle 13. It includes a downwardly extending barb 25 which extends back towards cover 21 of end cap 20 (FIG. 2). Barb 25 includes a bottom or lead surface 25*a* which slopes downwardly and in the direction of cover portion 21. That direction is a rearward direction with respect to the direction in which end cap 20 is inserted into arm socket 12*a*. Barb 25 then includes a bottom flat 25*b* and a tip 25*c*. Barb 25 extends downwardly to a point below the uppermost extremity of pintle socket 13. The plastic material of which end cap 20 is made and the dimensions of barb 25 should be such that bar 25 has sufficient flexibility that it will slide over the top of the leading edge of pintle socket 13, and has sufficient resiliency that it will snap down behind the interior portion of pintle socket 13 so as to lock end cap 20 in place once it is inserted. Castor pintle 13 itself has a beveled top edge 13*a* which also facilitates the sliding action of barb 25*a* over the top of pintle socket 13. The relative size of barb 25 relative to the rest of end cap 20 can be seen by reference to FIGS. 3 and 5.

Figure 6:
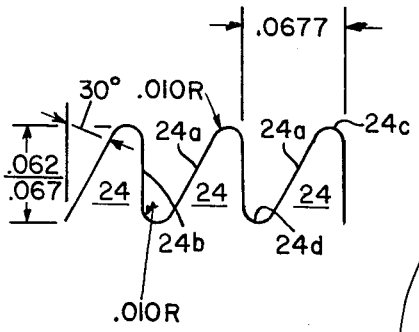
FIG. 6 is a detail drawing showing the slope and dimensions of the annular locking ridges of the end cap.

The surface of plug 22 is comprised of a plurality of annular locking ridges 24. Referring to FIG. 6, it will be seen that each annular ridge 24 includes a tapered lead surface 24*a*, a generally flat back surface 24*b*, a top crest 24*c* and a rounded valley 24*d*. Actually, it will be noted that some of the ridges 24 are semi-annular in that as one proceeds forwardly along the length of plug 22, the plug is, in a sense, cut into main body portion 22*a* and extending portion 22*b*. Only three of the ridges 24 are fully annular.

The peripheral dimensions of annular ridges 24 are just slightly greater than the corresponding interior peripheral dimensions of the arm socket 12*a* such that there is a tight friction fit between the crests 24*c* of ridges 24 and the interior surfaces of arm socket 12*a*. For example, in the case of the oval end cap and oval socket shown in the drawings, the major dimension of the plug portion, from crest to crest, at least along the first three annular ridges 24, is about 1.444 inches. In contrast, the corresponding interior dimension on the arm socket 12*a* is about 1.424 inches. As a result, a forced fit is achieved between the crests 24*c* of the annular ridges 24 and the interior surface of socket 12*a*. Further, because the plastic material of which end cap 20 is made has some rigidity, and because the crests 24*c* on extending portion 22*b* of plug 22 are formed on the same radius as the crests of the remaining annular ridges, even the semi-annular ridges 24 on the extending portion 22*b* of plug 22 have some locking effect.

In spite of the forced fit between annular ridges 24 and the interior of arm socket 12*a*, the insertion of end cap 20 into arm socket 12*a* is fairly easy because of the sloped lead surface 24*a* of each annular ridge 24. Lead surface 24*a* is sloped on an angle of approximately 30° to the vertical, or in other words, an angle of approximately 60° with respect to the axis of plug 22. This allows the annular ridges to slide in past the leading edge of socket 12*a*. This action is further facilitated by the fact that the back edge 24*b* of each annular ridge 24 defines a plane generally perpendicular to the axis of plug 22 such that it offers relatively little resistance to the upper portion of each annular ridge being folded over slightly as the ridge is inserted into the interior of arm socket 12*a*. This not only enhances insertion, but makes removal that much more difficult. This action is also enhanced by the fact that ridges 24 are not too thick. Preferred dimensions, in inches, for ridges 24 in this preferred embodiment are shown in FIG. 6.

End cap 20 is hollowed out in the center at 26 (FIG. 3) and as can be seen by the hidden lines in FIG. 2, this is simply a lightening step to facilitate molding end cap 20 with less material.

In operation, pintle sockets 13 are first welded to base arms 12 such that they extend upwardly into the interior of the socket portion 12*a* of each arm 12. End cap 20 is then inserted into the open end of arm socket 12*a* until barb 25 slides over the leading beveled edge 13*a* of pintle socket 13 and then snaps in behind the leading edge of pintle socket 13 so that removal of end cap 20 is eliminated. In this way, the leading edge of pintle socket 13 acts as a detent for holding end cap 20 in place. The sloped, oversized annular ridges further minimize the chances of removing end cap 20 without making it unduly difficult to insert end cap 20.

Of course, it is understood that the above is merely a preferred embodiment of the invention and that various changes and alterations may be made without departing from the spirit and broader aspects of the invention.

The embodiments of the invention in which an exclusive property or privilege is claimed are defined as follows:

1. In an article of furniture having a first socket with an opening to be covered, the improvement comprising: said first socket including a detent member therein extending from an interior surface thereof; a cap including a cover portion for covering the opening of said first socket and a plug portion extending from said cover portion; said plug extending into said first socket and over and beyond said detent member; said plug including a barb extending downwardly therefrom behind and adjacent said detent member; said barb being sufficiently flexible relative to said plug to allow it to slide over said detent member and being sufficiently resilient to slip down behind said detent member after it has slid over it, whereby insertion of said plug is facilitated whereas removal is not.

2. The article of claim 1 in which said barb slopes downwardly relative to said plug and back towards said cover portion.

3. The article of claim 2 comprising a chair base with radiating arms, said first socket with an opening comprising the end portion of each said arm; said detent comprising a pintle socket extending through the bottom of said arm and into the interior of said first socket, there being a space between the top of said pintle socket and the upper interior surface of said first socket.

4. The article of claim 3 in which said plug includes a first portion adjacent said cover having peripheral dimensions corresponding generally to the interior dimensions of said first socket and an extending portion extending from said first portion out over said detent member.

5. The article of claim 4 in which at least said first portion of said plug includes at least one generally annular locking ridge having peripheral dimensions slightly greater than the interior dimensions of said first socket such that a friction fit is effected between said locking ridge and the interior of said first socket; said annular locking ridge including a sloped lead surface sloping upwardly and rearwardly relative to the direction in which said cap is inserted into said first socket such that insertion of said end cap into said first socket is facilitated.

6. The article of claim 5 in which there are a plurality of said annular locking ridges at least on said first portion of said plug.

7. The article of claim 6 in which each said lead surface on each said annular locking ridge is oriented at approximately 60° to the longitudinal axis of said plug of said end cap.

8. The article of claim 7 in which said lead surface extends to a generally rounded crest and said rounded crest extends to a back surface, opposite said lead surface, said back surface being generally perpendicular to the longitudinal axis of said plug of said end cap.

9. The article of claim 8 in which semi-annular ridges are located on said extending portion of said plug such that they also engage the interior surface of said socket.

10. The article of claim 9 in which said end cap comprises a molded plastic member.

11. The article of claim 10 in which said end cap comprises a molded polypropylene copolymer plastic.

12. The article of claim 1 in which said article comprises a chair base with radiating arms, said first socket with an opening comprising the end portion of each said arm; said detent comprising a pintle socket member extending through the bottom of said arm and into the interior of said first socket, there being a space between the top of said pintle socket and the upper interior surface of said first socket.

13. The article of claim 12 in which said plug includes a first portion adjacent said cover having peripheral dimensions corresponding generally to the interior dimensions of said first socket and an extending portion extending from said first portion out over said detent member.

14. The article of claim 13 in which at least said first portion of said plug includes at least one generally annular locking ridge having peripheral dimensions slightly greater than the interior dimensions of said first socket such that a friction fit is effected between said locking ridge and the interior of said first socket; said annular locking ridge including a sloped lead surface sloping upwardly and rearwardly relative to the direction in which said cap is inserted into said first socket such that insertion of said end cap into said first socket is facilitated.

15. The article of claim 14 in which there are a plurality of said annular locking ridges at least on said first portion of said plug.

* * * * *